US005133674A

United States Patent [19]

Albrecht

[11] Patent Number: 5,133,674

[45] Date of Patent: Jul. 28, 1992

[54] FLAT RIBBON CABLE STRAIN RELIEF FITTING

[75] Inventor: William H. Albrecht, Austin, Tex.

[73] Assignee: Minnesota Mining and Manufacturing Company, St. Paul, Minn.

[21] Appl. No.: 766,022

[22] Filed: Sep. 26, 1991

[51] Int. Cl.[5] ..... H01R 13/58

[52] U.S. Cl. ..... 439/465; 439/456; 439/499

[58] Field of Search ..... 439/456–462, 439/499

[56] References Cited

U.S. PATENT DOCUMENTS

| | | | |
|---|---|---|---|
| 3,936,128 | 2/1976 | D'Amnessa et al. | 339/98 |
| 4,108,527 | 8/1978 | Douty et al. | 439/465 |
| 4,444,449 | 4/1984 | Aysta et al. | 339/99 |
| 4,621,886 | 11/1986 | Morgan | 339/107 |
| 4,721,483 | 1/1988 | Dickie | 439/610 |
| 4,804,342 | 2/1989 | Rudy, Jr. et al. | 439/467 |
| 4,842,547 | 6/1989 | Defibaugh et al. | 439/460 |
| 4,859,205 | 8/1989 | Fritz | 439/445 |

FOREIGN PATENT DOCUMENTS

| | | | |
|---|---|---|---|
| 1170326 | 7/1984 | Canada | 339/48 |
| 1170327 | 7/1984 | Canada | 339/48 |
| 1666319 | 3/1964 | Fed. Rep. of Germany | 439/456 |

*Primary Examiner*—Eugene F. Desmond
*Attorney, Agent, or Firm*—Gary L. Griswold; Walter N. Kirn; David W. Anderson

[57] ABSTRACT

A flat cable strain relief fitting accommodates various thicknesses of cable by providing a first fitting half which includes stair-step type slots which support a bar at various heights above the major surface of the first fitting half. The bar thus is adjustable in height to contact different thicknesses of cable and force the cable into clamping contact with a second half of the strain relief fitting.

7 Claims, 1 Drawing Sheet

FLAT RIBBON CABLE STRAIN RELIEF FITTING

TECHNICAL FIELD

The present invention relates generally to flat ribbon cables for data transmission and particularly to devices for capturing such cables and preventing movement of the cable in response to forces imposed on the cable.

BACKGROUND OF THE INVENTION

Flat ribbon cables, i.e., cables comprising a number of adjacent conductors, are widely used in the data transmission and communication fields to interconnect electronic devices such as communication equipment and computers. In the applications addressed herein the ribbon cable is external to a device housed in an enclosure and extends to connect that device to another or one cable is connected to another intermediate two electronic devices. The cable is terminated at both ends by connectors which mate with counterparts attached to the electronic devices or another cable to provide numerous electrical circuits. Since the cable is exposed, there exists the danger that forces (strain) placed on the cable will pull the cable free of its connector. Many devices have been produced which attach to the device enclosure and clamp the cable to prevent relative movement between the cable and the enclosure so that forces placed on the cable are not transmitted to the interface between the cable and its connector with the possible result of separating the two. Prior devices of this type are known as strain relief devices, or simply strain reliefs, and have generally been successful in preventing separation of the cable and its connector. Unfortunately, these strain reliefs have usually been custom-made for the particular cable to be used. Since ribbon cable is produced in various thicknesses, this approach has required that a large number of strain relief devices be provided and kept in stock to accommodate any of the possible cable thicknesses available.

SUMMARY OF THE INVENTION

The present invention overcomes the deficiencies of prior strain relief devices by providing a strain relief fitting designed to accommodate ribbon cables having various thicknesses. The strain relief of the present invention includes a first fitting half for attachment to the cable and a flat portion disposed generally parallel to the major surfaces of the cable when the first fitting half is positioned on the cable and two upstanding and opposed walls extending from the flat portion and spaced to accept the cable therebetween. Each wall includes a series of opposed slots paired with the slots in the other wall, which paired slots terminate at different distances from the flat portion, a bar sizedto extend substantially between the walls and fit within the slots wherein the bar may be inserted in any set of the paired slots to be suspended different distances from the first fitting half flat portion and support the cable at different distances from the flat portion and a second fitting half adapted for clamping connection to the first fitting half and having a flat portion from which extend bearing surfaces aligned with each of the slots, which bearing surfaces contact the cable when the second fitting half is connected to the first fitting half and force the cable against the bar.

The strain relief fitting may include three slots each extending a different distance from the first fitting half flat portion, and the slots may be arranged in a stair-like progression so that an end slot extends a minimum distance from the flat portion and the other end slot extends a maximum distance from the flat portion, with the slot between the end slots extending an intermediate distance from the flat portion.

In addition, the strain relief fitting may include supplementary projections extending from the first fitting half flat portion in the direction of the cable when the first fitting half is attached to the cable, the supplementary projections being disposed between and aligned with each of the paired slots andextending from the first fitting half a distance equal to the distance from the first fitting half flat portion its aligned paired slots extend so that the supplementary projections support the bar at a distance from the flat portion equal to its corresponding paired slots. These supplementary projections may extend completely between the upstanding walls to support the bar along its entire length.

The strain relief fitting may further be formed such that the bearing surfaces include narrowed ridges aligned with the slots to concentrate the force applied to the cable when the second fitting half is connected to the first fitting half.

Finally, the strain relief fitting ay include paired slots extending different distances from the second fitting half flat portion to support a second bar therebetween, the second fitting half slots being aligned with the first fitting half slots so that the first bar and the second bar may be independently positioned to accommodate a greater range of cable thicknesses than can be accommodated by the provision of an adjustable bar in one fitting half only.

BRIEF DESCRIPTION OF THE DRAWINGS

The present invention will be more fully described with reference to the accompanying drawings, wherein like numbers refer to like parts in the several views, and wherein.

DESCRIPTION OF THE PREFERRED EMBODIMENT

Figure 1:
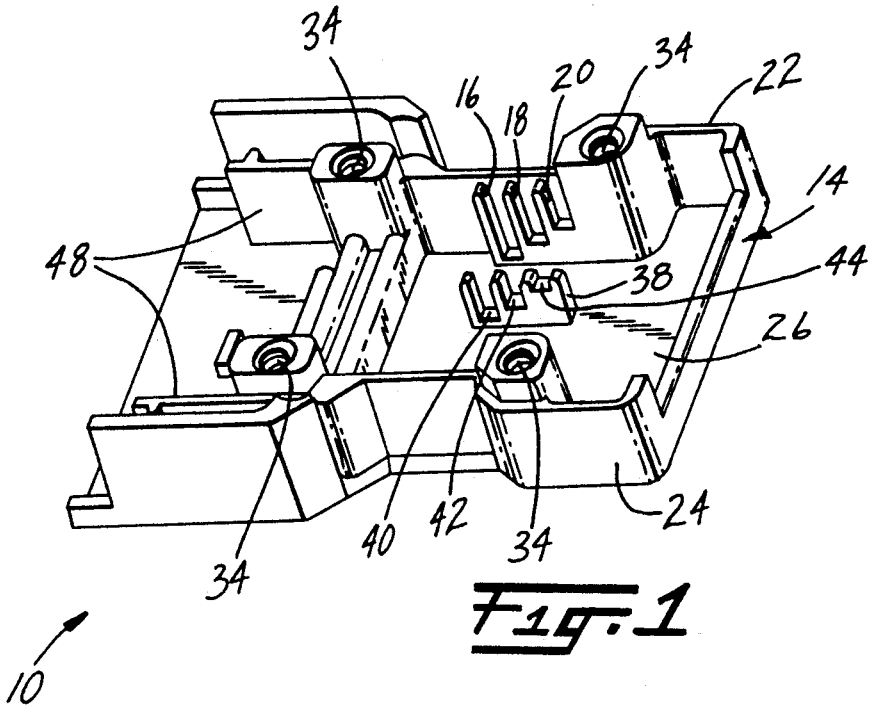
FIG. 1 is a perspective view of one half of a strain relief fitting according to the present invention.
Figure 2:
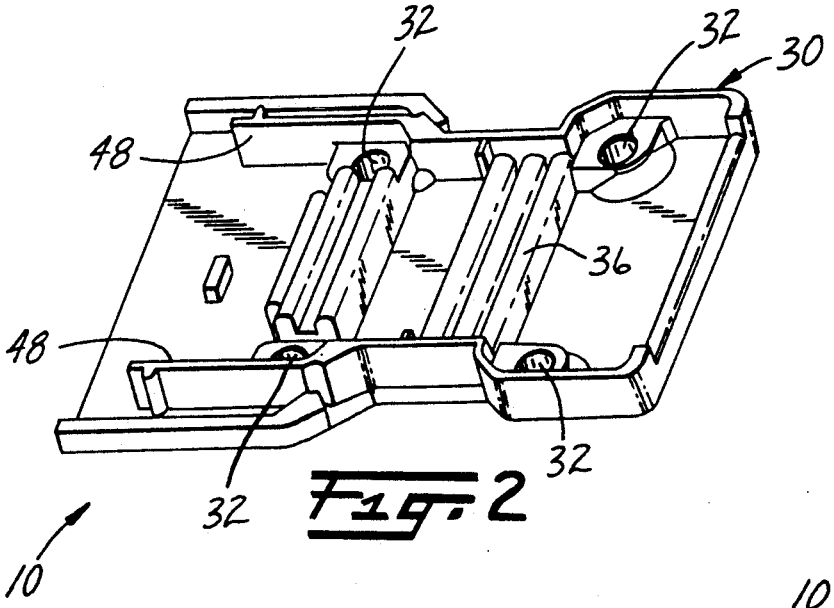
FIG. 2 is a perspective view of a second half of the strain relief fitting of the present invention.
Figure 3:
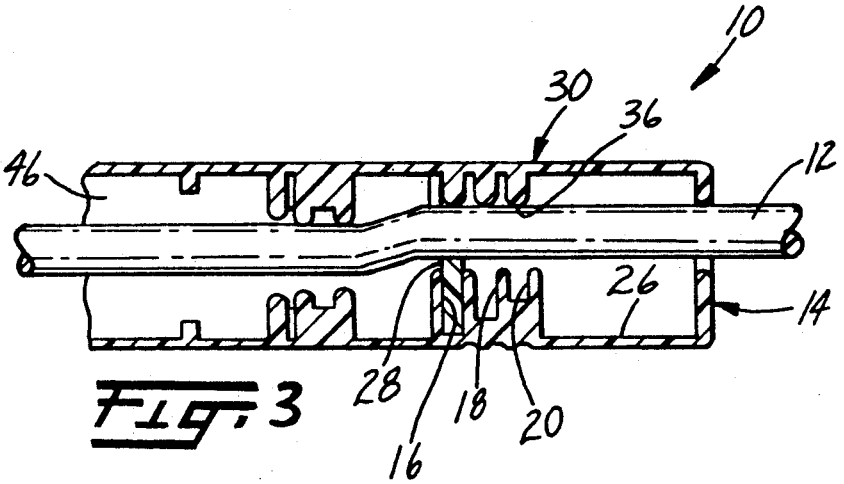
FIG. 3 is a cross-sectional view of the two halves of the strain relief fitting of the invention assembled to a portion of a ribbon cable with portions of the fitting halves deleted for clarity.

FIGS. 1 and 2 illustrate collectively a strain relief fitting, generally indicated as 10, of the present invention, with FIG. 1 illustrating one half and FIG. 2 the other half. FIG. 3 illustrates the strain relief fitting 10 in cross-section as the strain relief fitting 10 is attached to a cable 12. The cable 12 is a so-called flat ribbon cable wherein a number of separate, insulated conductors are disposed in side-by-side relationship with the insulation of adjacent conductors connected. The cable 12 may also include a jacket, usually of metal for grounding or shielding purposes, and may further include another overall layer of insulation. Ribbon cables 12 are produced in various widths and thicknesses and include varying numbers of conductors. The cable 12, in one application, is terminated at both ends by connectors (not shown) which typically includes a body half having a number of insulation piercing contacts adapted to cut through the cable 12 insulation and make electrical contact with the conductors of the cable 12 when the connector body isforced into the cable 12. A cover attached to the connector body half completes the assembly of the connector to the cable 12. This connector may then be mated with another connector to provide electrical contact between the conductors of the cable 12 and another cable or electronic device.

The connection between a cable 12 and a connector formed in the described fashion is reliable but may be damaged if sufficient force (strain) is applied to the cable in a manner which would tend to pull the cable 12 from the connector and thus separate the cable 12 conductors from the connector contacts. To prevent accidental removal of the cable 12 from the connector, there have been devised devices known as strain relief devices, or, more simply, strain reliefs, which clamp to the cable 12 and absorb the force applied to the cable 12 so that the cable 12 is not separated from its connector or the connector is not separated from its mating connector. The present invention is directed to such a strain relief, but one which will accommodate cables 12 having a number of different thicknesses.

With reference to FIG. 1, this thickness variation accommodation is accomplished by providing a first strain relief fitting half 14 including a number of slots 16, 18 and 20 formed in upstanding, opposed walls 22 and 24 extending perpendicularly from a flat portion 26 of the first fitting half 14. As best seen in FIG. 3, the flat portion is parallel to the major surfaces of the cable 12 when the fitting half 14 is attached to the cable 12.

The slots 16–20 terminate at different distances from the flat portion 26 of the fitting half 14 and are preferably arranged in stair-step fashion. The slots 16–20 are formed as paired, mirror image structures in each of the walls 22 and 24 and are adapted to accommodate a bar 28 which may be placed in any of the three paired slots 16–20. The bar is substantially rectangular in cross-section and has a length sufficient to span the distance between the walls 22 and 24 so as to be adequately supported within the slots 16–20. The slots 16–20 are disposed in relationship to each other such that the bar 28 spans the relief fitting 10 in a direction substantially perpendicular to the length of the cable 12. As shown in FIG. 3, the bar 28 may be positioned in any of the paired slots 16, 18 or 20 to support the cable 12 at three different heights above the flat portion 26 of the first fitting half 14.

Assembly of the strain relief fitting 10 is accomplished by positioning the bar 28 in a selected pair of slots 16, 18 or 20 and positioning the cable 12 over the bar 28 perpendicular to the length of the bar 28. Then a second half 30 of the fitting 10 is placed over the cable 12 and attached to the first fitting half 14 by means of screws (not shown) inserted through holes 32 in the second fitting half 30 and screwed into threaded holes 34 in the first fitting half 14. Tightening of the attachment screws forces a bearing surface 36 into contact with the cable 12 and securely captures the cable 12 between the bearing surface 36 and the bar 28.

The bearing surface 36 is disposed directly opposite each of the slots 16–20 when the fitting halves 14 and 30 are connected and so will force the cable 12 directly into contact with the bar 28 no matter which of the three slots 16–20 is selected. The bearing surface 36 is actually shown as three separate structures each aligned with one of the slots 16–20, but could simply be one projection equal in width to the three projections shown. Three projections are preferred so that the portions of the bearing surface 36 opposite the slots 16–20 may be rounded or tapered to concentrate the clamping force applied to the cable 12 and, again preferably, actually indent the surface of the cable 12 to greatly increase resistance to pull-out of the cable 12 from the fitting 10. Likewise, the bar 28 could have a rounded or tapered end to indent the cable 12.

Depending upon the clamping force which is desired to be applied to the cable 12, the first fitting half 14 may be provided with one or more projections 38 extending from the flat portion 26 of the first fitting half 14. This projection or projections 38 are structured with slots 40–44 corresponding in height and aligned with the paired slots 16–20 and are provided to support the bar 28 along its length to prevent bending in the event a high clamping force between the two fitting halves 14 and 30 is required. As many projections 38 as desired may be provided between the walls 22 and 24 and, ultimately, the projection 38 could extend continuously from one wall 22 to the other 24.

Although the cable is shown as extending through the fitting 10 for simplicity, normally the cable would be terminated by a connector and this connector located within an open area 46 at one end of the fitting 10. The fitting !0 also normally would be attached by means of latches 48 to another strain relief fitting 10 or the housing of an electronic device so that forces placed on the cable 12 would be absorbed at the latches 48.

The present invention has thus been described with respect to only a single embodiment. It will be apparent to those skilled in the art, however, that many modifications are possible. For example, any number of slots could b provided to accommodate any number of cable thicknesses and it will be noted that a thickness of cable greater than that shown may be accommodated by removing the bar 28 and clamping the cable directly between the ends of the slots 16–20 and the bearing surface 36. Furthermore, the slots 16–20 and the bar 28 could be of any cross-sectional shape, so long as the bar 28 is firmly supported, and the second fitting half 30 could be provided with slots and a second bar to multiply the number of cables 12 of different thicknesses which could be accommodated by the strain relief fitting 10.

I claim:

1. A strain relief fitting for clamping one of a number of flat ribbon cables having various thicknesses, comprising:

a first fitting half for attachment to the cable and including a flat portion disposed generally parallel to the major surfaces of the cable when said first fitting half is positioned on the cable and two upstanding and opposed walls extending from said flat portion and spaced to accept said cable therebetween, each wall including a series of opposed and paired slots, which said paired slots terminate at different distances from said flat portion;

a first bar sized to extend substantially between said walls and fit within said slots wherein said bar may be inserted in any set of said paired slots to be suspended different distances from said first fitting half flat portion and support the cable at different distances from said flat portion; and a second fitting half adapted for clamping connection to said first fitting half and having a flat portion from which extend bearing surfaces aligned with each of said slots, which bearing surfaces contact the cable when said second fitting half is connected to said first fitting half and force the cable against said bar.

2. A strain relief fitting according to claim 1 including three slots each extending a different distance from said first fitting half flat portion.

3. A strain relief fitting according to claim 2 wherein said slots are arranged in a stair-like progression so that an end slot extends a minimum distance from said flat portion and the other end slot extends a maximum distance from said flat portion, with the slot between said end slots extending an intermediate distance from said flat portion.

4. A strain relief fitting according to claim 1 further including at least one supplementary projection extending from said first fitting half flat portion toward the cable when said first fitting half is attached to the cable, said supplementary projection including slots disposed between and aligned with each of said paired slots and extending from said first fitting half flat portion a distance equal to the distance from said first fitting half flat portion its aligned paired slots extend so that said supplementary projections support said bar at a distance from said flat portion equal to its corresponding paired slots.

5. A strain relief fitting according to claim 4 wherein said supplementary projections extend completely between said upstanding walls to support said bar along its entire length.

6. A strain relief fitting according to claim 1 wherein said bearing surfaces include narrowed ridges aligned with said slots to concentrate said force applied to said cable when said second fitting half is connected to said first fitting half.

7. A strain relief fitting according to claim 1 wherein said second fitting half includes paired slots extending different distances from said second fitting half flat portion to support a second bar therebetween, so that said first and said second bars may be independently positioned within said slots to multiply the number of cable thicknesses which may be accommodated.

* * * * *